US005987792A

United States Patent [19]

Reyes-Paris

[11] Patent Number: 5,987,792

[45] Date of Patent: Nov. 23, 1999

[54] SYSTEM FOR APPLYING CONTINUOUS ADVERTISING IN A DISPLAY DEVICE WITH CONTINUOUS OR SEQUENTIAL ANIMATION

[76] Inventor: Luis Alfonso Reyes-Paris, Circuito Valle Azul No. 72, Lomas de Valle Escondido, Atizapan de Zaragoza, 52930 Edo. de México, Mexico, 52930

[21] Appl. No.: 08/886,618

[22] Filed: Jul. 1, 1997

[51] Int. Cl.[6] ..... G09F 11/12

[52] U.S. Cl. ..... 40/472; 40/524

[58] Field of Search ..... 40/572, 524

[56] References Cited

U.S. PATENT DOCUMENTS 1,966,634 7/1934 Von Der Lippe-Lipski ..... 40/472

FOREIGN PATENT DOCUMENTS 538330 10/1956 Italy ..... 40/472
6118885 4/1994 Japan ..... 40/472
222630 10/1924 United Kingdom ..... 40/472
3014485 7/1993 WIPO ..... 40/472

*Primary Examiner*—Cassandra H. Davis
*Attorney, Agent, or Firm*—Ladas & Parry

[57] ABSTRACT

A system for providing continuous promotional space for advertising media, with movement and animation, which is represented by optical line units having at least a set of continuous webs having on the surface of the front part thereof, a plurality of optical lines that upon overlapping one next to the other in a parallel manner, form a complete image. The sets of continuous webs are moved synchronically in order to form a plurality of advertising images that change sequentially as the webs are sequentially moved by a driven system provided with an interval-timer device.

14 Claims, 16 Drawing Sheets

6
7
6
8
8
9
6
12
8
5
4
13
2
5
10
3
11
14

7
6
3
11
9
8
2
11
11

SYSTEM FOR APPLYING CONTINUOUS ADVERTISING IN A DISPLAY DEVICE WITH CONTINUOUS OR SEQUENTIAL ANIMATION

FIELD OF THE INVENTION

The present invention refers to the field of advertising, both static as dynamic, since it has the possibility of showing information about products and services, in a fixed form or in animated movement.

In a more particular way, the invention refers to a sequential and continuous display system of advertising, by means of the combination of a plurality of image segments, each one constituting an optical line, and which by being displayed simultaneously, in combination form an image viewable during a defined time, which is determined by a temporary synchronization system, even allowing that the advertising information displayed by means of images possess sequential or continuous animation.

BACKGROUND OF THE INVENTION

Currently there are several information display systems based in images printed or painted in different type of substrates. As the best known, there are fixed advertisements which can be sundry sizes and showing a single static image, which is printed, painted, or reproduced by any means on a substrate or a general rigid background.

A second type of visual information display system corresponds to the advertisements or advertisement presentations, comprising a plurality of visual exhibit elements, which are comprised by rectangular prisms presenting three surfaces or flat faces, each one thereof being located axially in a 120 degrees angle with respect to the other two. The visual display elements are located in adjacency in parallel way and present a spin movement of their longitudinal axis, in a way that at a given moment, the combination of the surfaces of one of the faces of each visual display element, upon spinning on its axis and staying in a image match position, form a complete visual display of an advertisement image.

Each one of the surfaces of the visual display elements presents a image segment in a way that when simultaneously, each element makes a 120 degrees spin over its axis, the combination of the individual images of each one of the faces remaining at that moment at the sight of the public, constitutes a complete image.

Evidently, this system is limited to the presentation of only three advertisement images and has as a main disadvantage that in a certain moment, the mechanism spinning the triangular elements forming the visual representation, may be damaged losing the synchrony in the images represented, forming those mixed images of the three advertisements. On the other side, during the spin of the triangular elements on their axis, there is a time period in which, the image is broken, when momentarily the surface of image display is deformed.

Other static advertising systems are known, such as those generally used in stadiums and places of large flow of public and consisting of continuous webs generally made from paper, plastic material or textile forming a roll. These webs have a determined amount of information or advertising adds printed on their surface, which are represented sequentially as the web advances toward one direction or the other, upon winding or unwinding.

This type of advertisement display system offers the possibility to display a bigger amount of advertisement that the systems mentioned before, but still they have as disadvantage the fact that the advertisement is static and due to the large size of the free spaces covering each advertisement and the features inherent to the material from which is made, the continuous web tends to slack and stretch in a way that it is exposed to the potential damages of wear, break, etc. Another disadvantage that this system has, is that during the change of an advertisement image for another, there is a determined time in which two advertisement images coincide.

The system subject of the present invention has as main object to overcome the disadvantages of today's known systems, providing a series of advantages that will become evident upon reading of the present specification.

The system for application of continuous advertisement in a display device with sequential or continuous animation of the present invention, is formed by the simultaneous presentation of a plurality of parallel aligned optical lines, one to the side of the other. Each one of the optical lines corresponds to a proportional part of the image to be displayed and being printed on a optical line unit consisting of a endless web sliding over bearing axis forming a "V", "W" or "WW" shaped path per optical line unit. This endless web contains a series of printed optical lines one next to the other, in a way that when the system is working, the corresponding images on each step of the optical line being sequentially succeeding during a determined period of time controlled by a timer device. The simultaneous display of the complementary optical lines on each one of the optical line units, yields the final complete image displayed to the public. As just mentioned, the advertising image exposed to the public is formed by the simultaneous representation of the whole of the complementary optical lines and has as main feature the fact to display a better view of the represented advertising image, since the display angle never changes and the image always remains completely flat, without holes and allowing to be perceived without error, in a way that while appearing one and another image the images sequenciation is immediate and perfect.

Such capacity of the system of the present invention is infinite, but preferably it should be kept within a range comprised between forty to two hundred images. In this system, each one of the webs constituting each unit of optical line, having printed on its surface a plurality of optical lines, slides with an endless movement towards the required direction, be either leftwards or rightwards, in a way that during its movement, which is programmed by a timer mechanism, it is stopped during a certain determined period of time, during which the image formed in this moment due to the combination of the complementary optical lines of each optical line unit, is exposed to the sight of the public.

The endless web is contained in a structure or furniture that may adopt several geometric shapes, the rectangular, square, circular or triangular shape being the preferred, and the optical lines may be located vertically, horizontally or diagonally.

Given the design and construction characteristics, there is no deformation possibility whatsoever per optical line either due to its operation or by being exposed to environmental conditions.

The furniture or structure generally has the shape of a geometric solid, thus its side and backward faces can be used additionally as a fixed advertisement space. The, presentation form can be face down, face up, standing up, lying down or it may be fixed or in movement.

Because of the minimum separation between a optical line and another adjacent optical line, the legends and images formed by the combination of the optical lines mentioned, can be appreciated at 100% with an excellent definition degree.

DETAILED DESCRIPTION OF THE INVENTION

Figure 1:
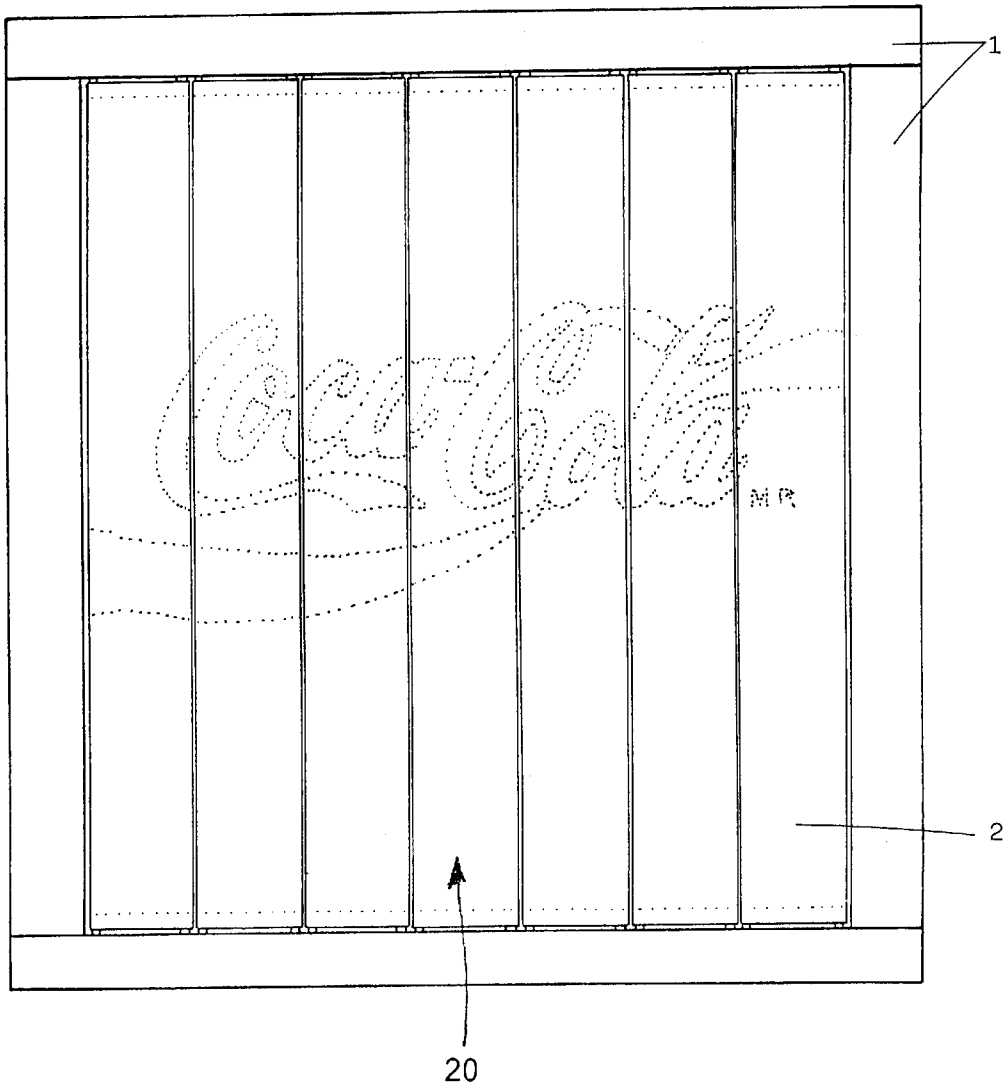
FIG. 1 represents a front view of the support structure and the optical line units in vertical alignment.
Figure 2:
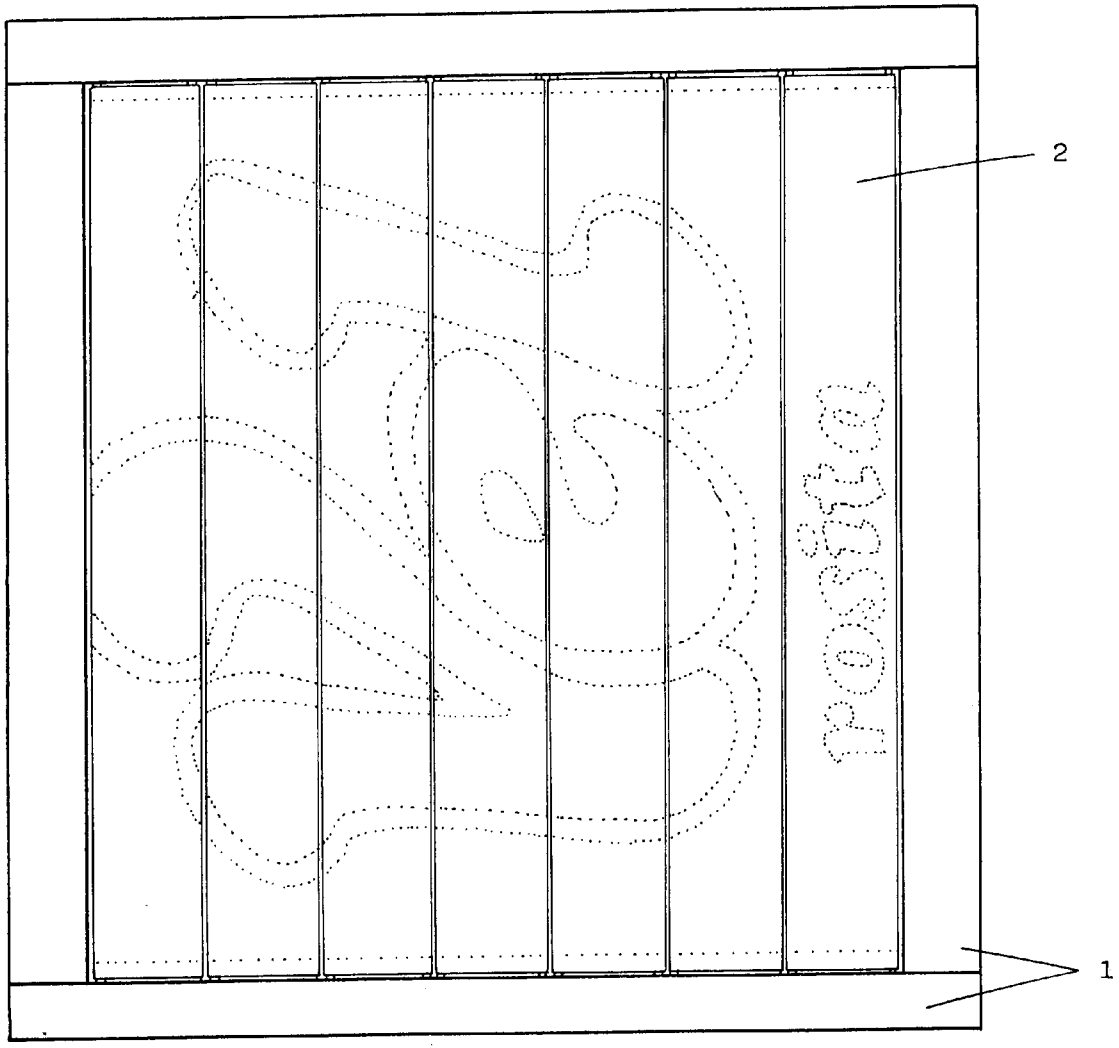
FIG. 2 represents a similar front view alternative of the system of FIG. 1, showing the optical lines in horizontal alignment.
Figure 3:
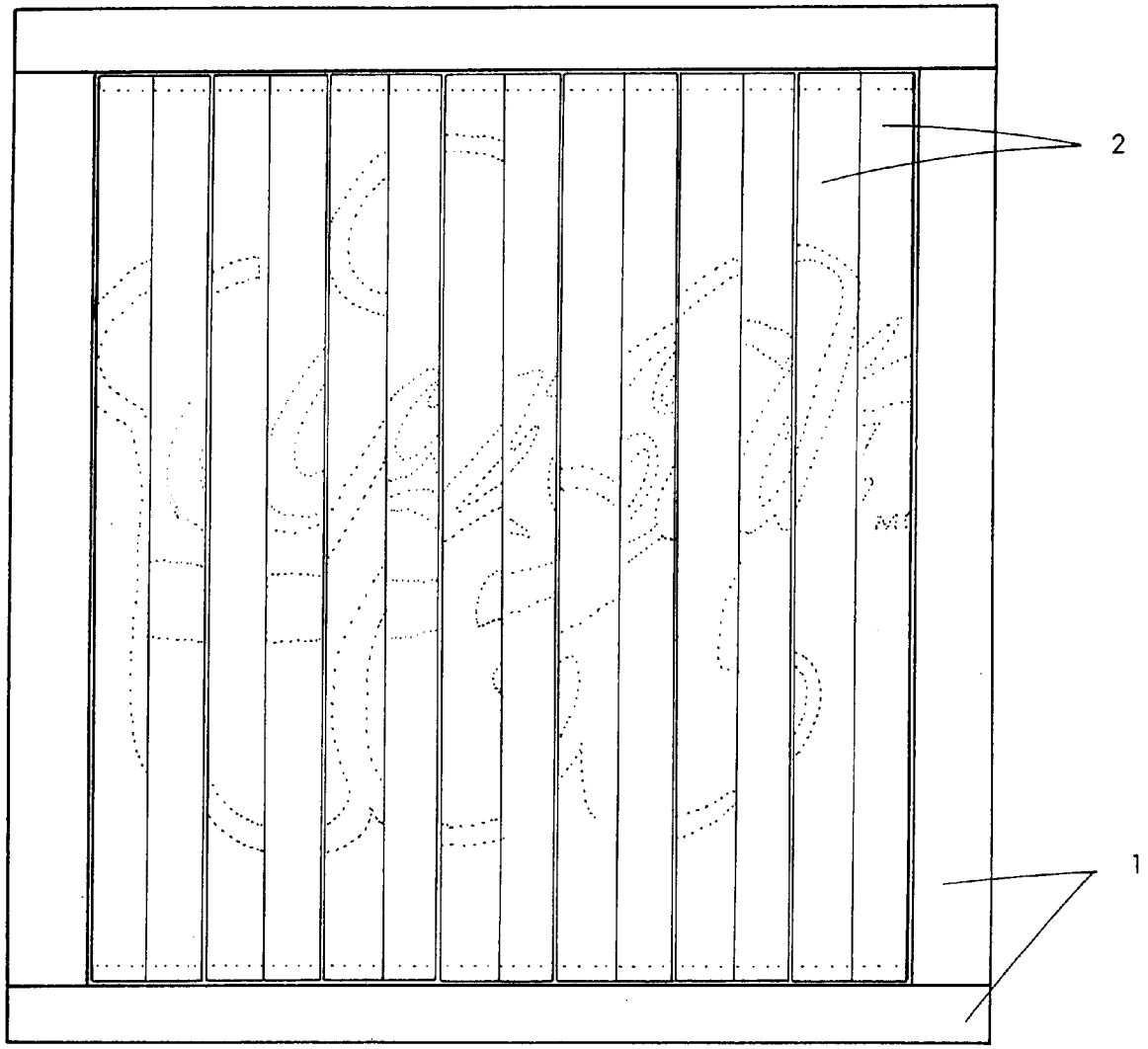
FIG. 3 represents a front view in which the change of figures during timed movement of the optical lines carrier web can be appreciated.
Figure 4:
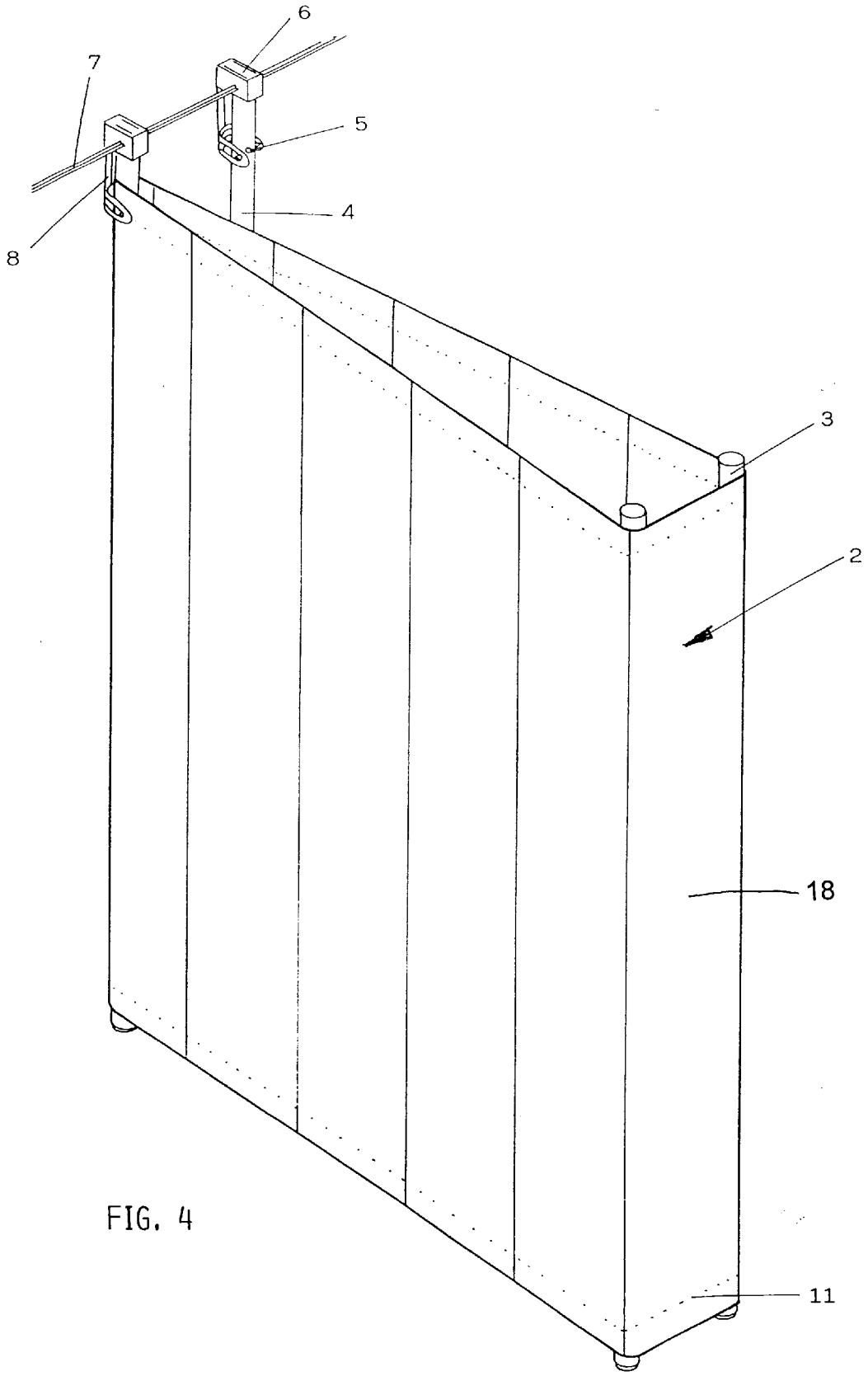
FIG. 4 shows a perspective view of a portion of the optical lines carrier web showing the detail of the optical line unit.
Figure 5:
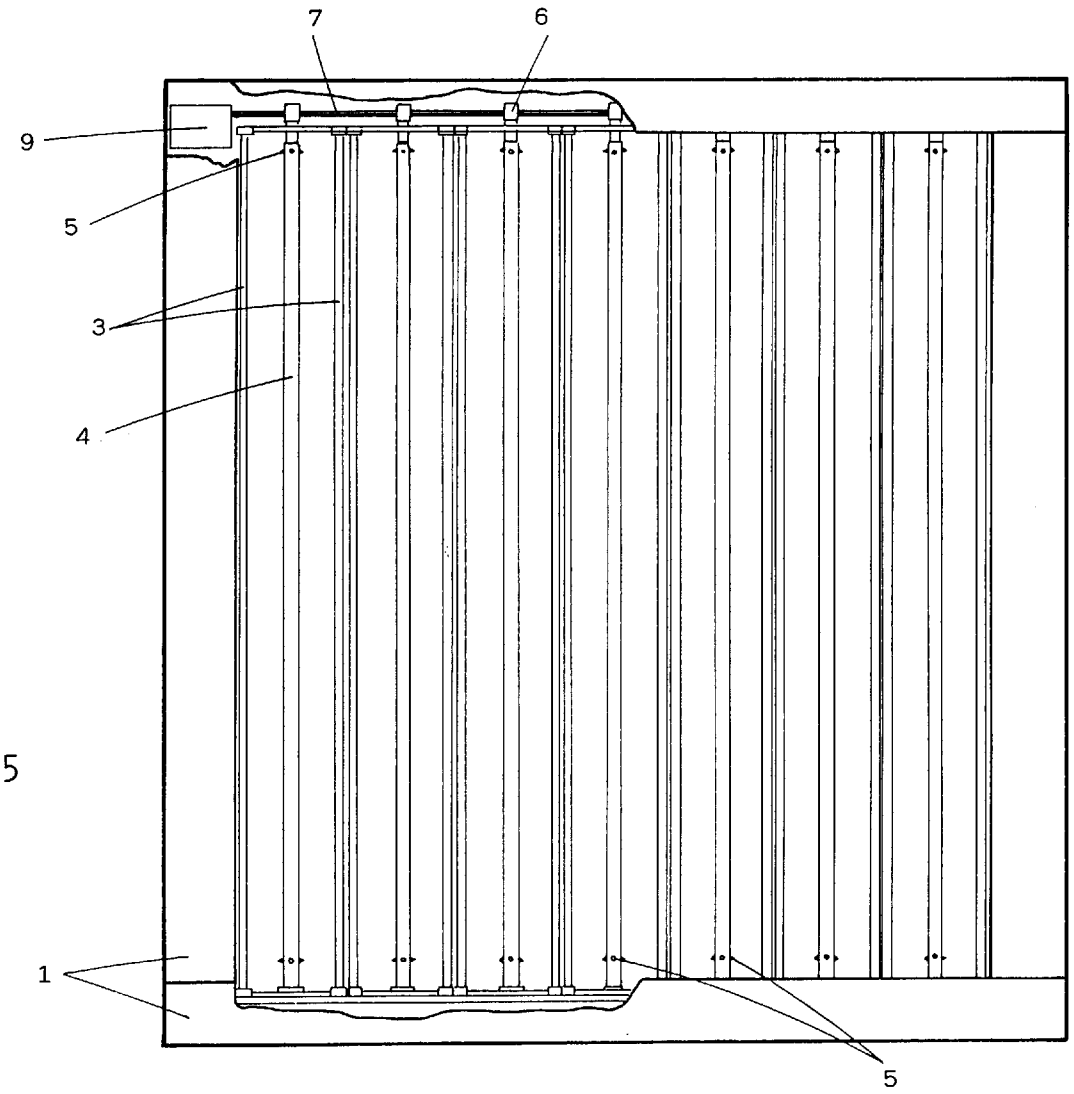
FIG. 5, is a sectional view of the system, showing the timer motoreducer.
Figure 6:
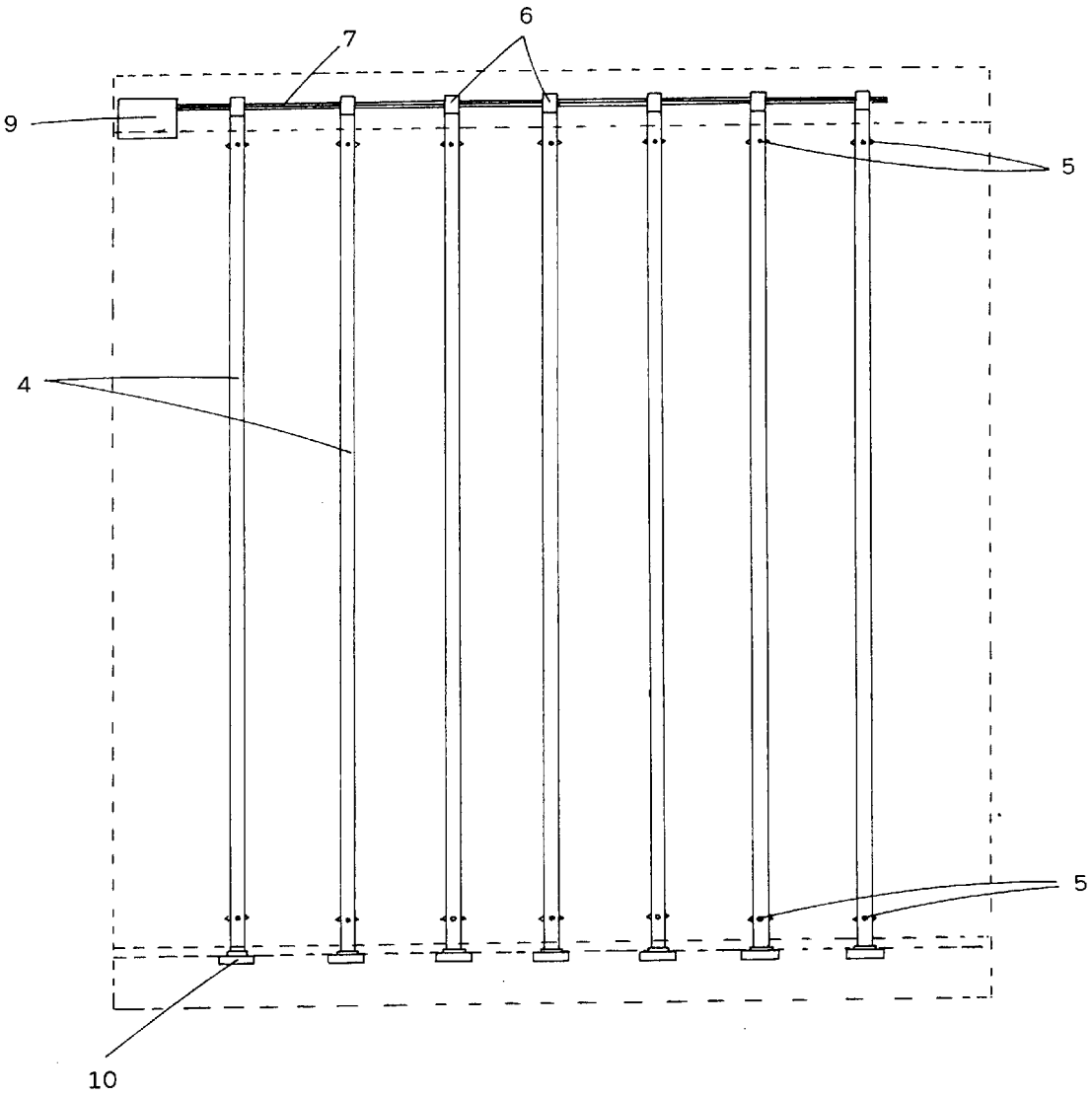
FIG. 6 is a detailed view of the back part of the system showing the location of the timed motoreducer and of the back roller with upper and lower drag teeth, geared to the central synchronizer axis.

The system for applying continuous advertisement in an animated display device comprises a support structure (1), presenting a visual display surface (20) formed by the combination of complementary optical lines (2) contained in a plurality of optical line units (18), each one of which is formed by an endless web, having its front surface printed with a plurality of optical lines (2), having as an alternative embodiment, that both faces can be printed. The optical lines (2) comprise image fractions located one at the side of the other in a synchronized sequential manner, which when combined forms the complete image of the visual display.

The system works by the forward movement action produced by an interval-timed motoreducer (9), that produces spinning a central synchronizer axis (7), which is coupled to a synchronizer male gear (6) of each one of the optical line units, which while being geared causes the spinning of a respective back roller (4), having drag teeth in its upper and lower parts, which provides synchronous movement to all the endless webs (18), which have perforations (11) in their upper and lower parts, having as a function the coupling with the drag teeth of the back roller (4) to make it continuously rotate. In the front part of each optical line unit formed by an endless web (18), there are two frontal idle rollers (3), without drag teeth, supported by front bearings (17), and providing uniform quadrature and tension to the perforated web (18), continuously spinning in the direction driven by the back roller (4), in a way that by multiplying the optical line units (2), they will proceed in sequence, geared in the same form in a synchronical manner and forming a perfect image on its frontal face.

The back rollers (4), being supported in its lower part with a back bearing (10), and in its upper part being subject to the synchronizer male gear (6), driven by the central synchronizer axis (7). All this system carries a support structure (1), for perfect operation.

Figure 7:
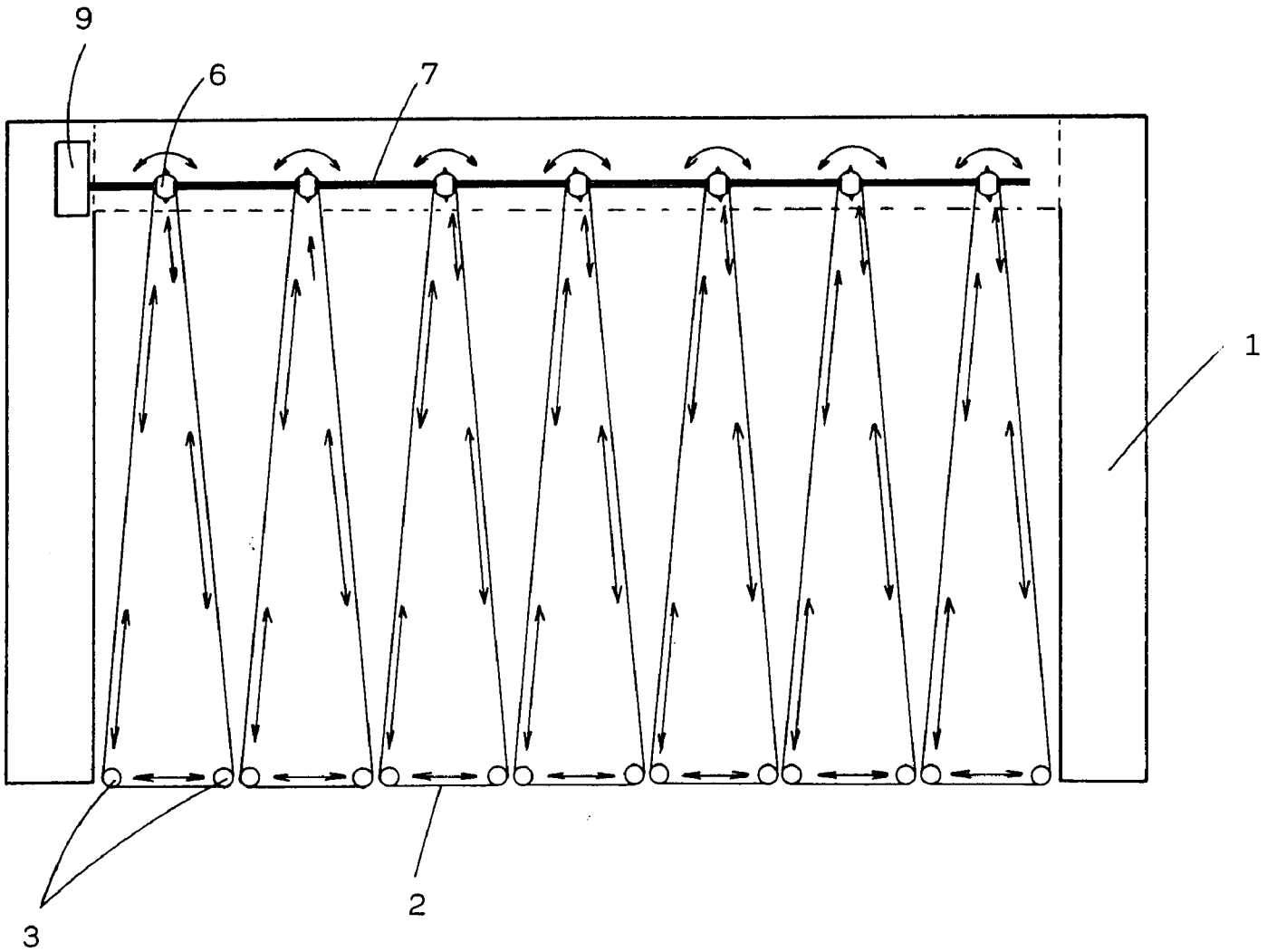
FIG. 7 is an upper view of the system in which each optical line unit can be seen working in both ways.
Figure 10:
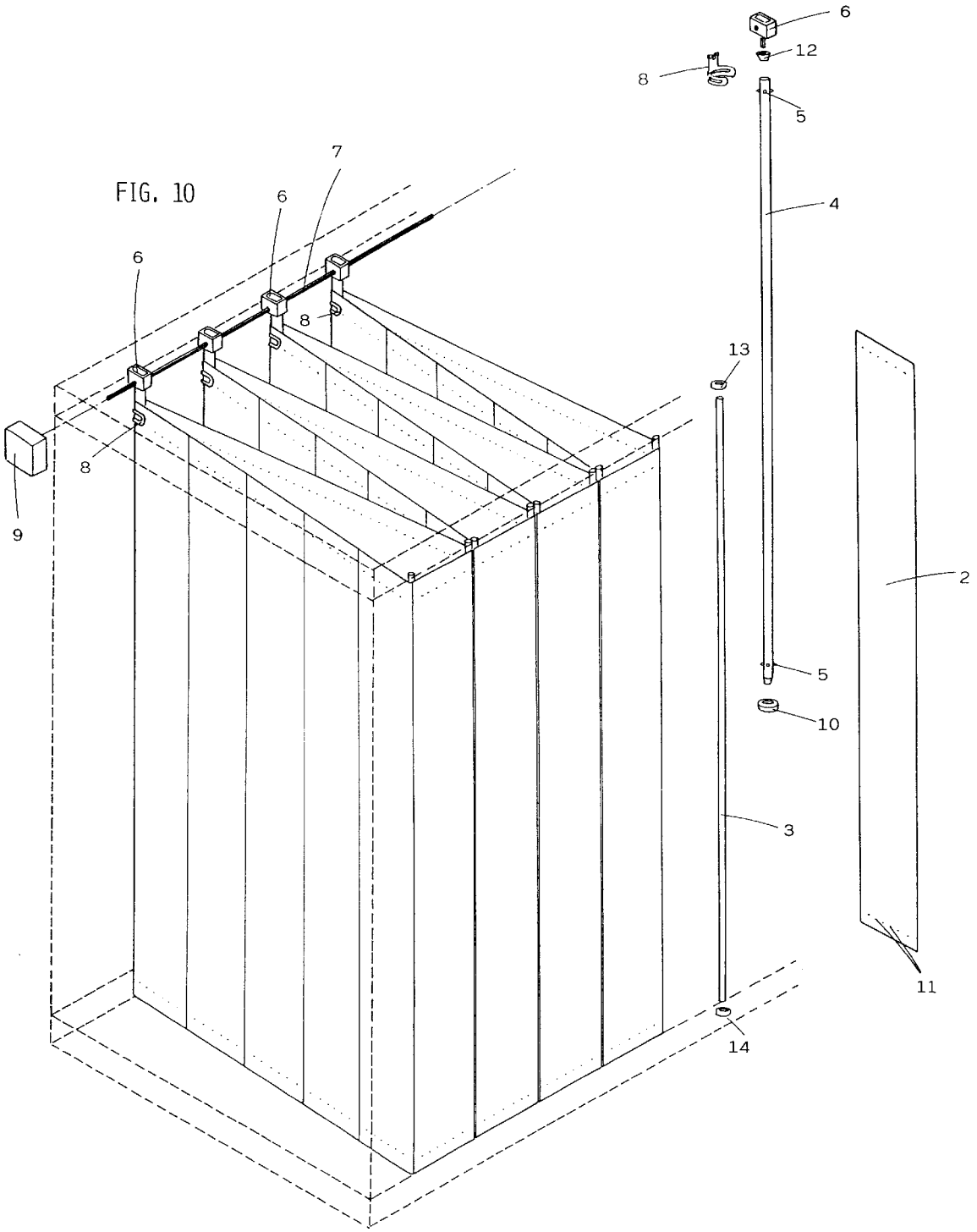
FIG. 10 shows a operating perspective of the optical line units, as well as a break apart of a front idle roller without drag teeth; of the back roller with drag teeth on its upper and lower parts and of the perforated optical line unit perforated.
Figure 11:
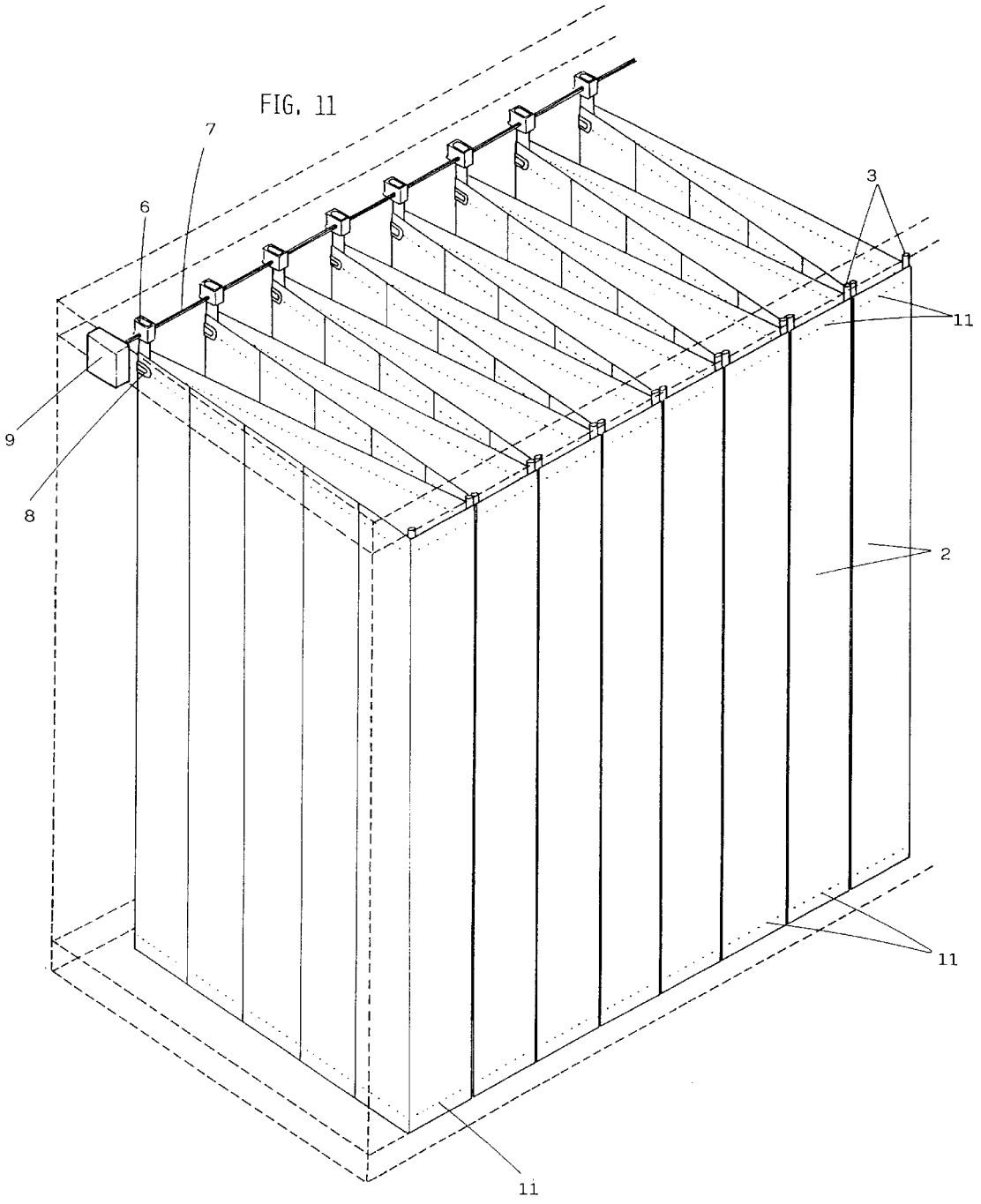
FIG. 11 is a perspective view shown the operation of the web with perforations in its upper and lower parts, mounted on its support structure.

Examples to Carry Out the Invention or Preferred Embodiments:

In a first embodiment, the invention as is shown in FIGS. 7, 10, and 11, comprises a continuous web (18), arranged in "V", forming a triangle limited by two front idle rollers (3) without drag teeth and a back roller (4) with drag teeth. The adjacent arrangement of the optical line units determines a path in the shape of adjacent triangles, in which, the bases of the triangles remain towards the front of the visual display system, each one of such bases of the triangles, is an optical line (2) having on their surfaces proportional parts of the advertisement image to be displayed. Each optical line (2) being adjacent to another parallel optical line, carrying on its surface the sequential continuation of the image to be represented, in a way that the union of all the optical lines provides a complete image.

The front idle rollers (3) are located vertically in parallel way and spinning freely over their vertical axis due to the spin support provided by respective front bearings (17) located in corresponding parts of the support structure (1) of the system. Upon spinning the front idle rollers (3) due to the friction on them by the endless web (18) during its movement in either of the two possible directions, they apply simultaneous uniform tension over the optical line which is limited by two adjacent idle rollers, which makes the surface of the visual display (20) formed by the combination of the respective optical lines (2) to remain tense enough so that the image displayed on it presents a convenient sharpness, without wrinkles or formation of blisters due to the slack of the material of which the continuous web (18) is made.

The movement of the plurality of continuous webs (18) is provided by a motoreducer (9) with an interval-timer, which can be programmed in a way that the images remain at sight during a desired time. The motoreducer (9) provides a spin movement to the central synchronizer axis (7), which in turn is coupled by means of a gear system such as a synchronizer male gear (6), or in another embodiment, a crown and pinion type helical gear system (19). This gear system is coupled to the upper part of each one of the back rollers (4) in such way that the spin movement of the rod constituting the horizontal central synchronizer axis (7), causes the simultaneous axial movement of all the back rollers (4) in a perfectly synchronized way.

The back rollers (4), are supported in their lower part with a back bearing (10), and in their upper part are subject to a synchronizer male gear (6) moving this central synchronizer axis (7). All this system, likewise is provided with a support structure (1) for its perfect operation.

Each one of the back rollers (4) has, in a place next to each one of its two ends, a plurality of small protrusions or drag teeth (5) equidistantly located in a peripheral way, coupled to the corresponding operations (11) of the continuous web (18), in such a manner that when the back rollers (4) rotate in an axial form, the drag teeth are coupled with the respective perforations (11) of the continuous web and provide a forward movement to the web once they are coupled with the corresponding perforations of the continuous web.

Each continuous web (18) is divided in a plurality of optical lines (2) that can be located in a vertical, horizontal or diagonal fashion. The continuous web (18) can be made of several materials, and also can be labeled, printed painted as a negative or through plastic coated canvasses for the installation already provided of the image.

The optical lines (2) are represented over the surface of the continuous web (18) in a sequential manner, in such a way that, depending on the number of images or advertisement messages contained in the continuous web (18), each optical line (2) will have its complimentary lines located at a distance equivalent to the number of messages contained in the continuous web. That is, if for example, the system contains ten advertisement messages and in turn comprises ten endless webs (18), each endless web will be divided in ten optical lines (2), in a way that by joining side to side the complementary optical lines (2) of the ten optical line units (18), they form the first of the images. At the end of a determined time, previously programmed by the interval-timer, the motoreducer will carry a simultaneous movement action of all the optical line units (18), making them to advance one step forward, at that time the respective optical lines (2) corresponding to the second image are exposed. This action is sequentially repeated until the ten advertisement messages have been exposed to the public and continues indefinitely repeating to display the messages.

Figure 9:
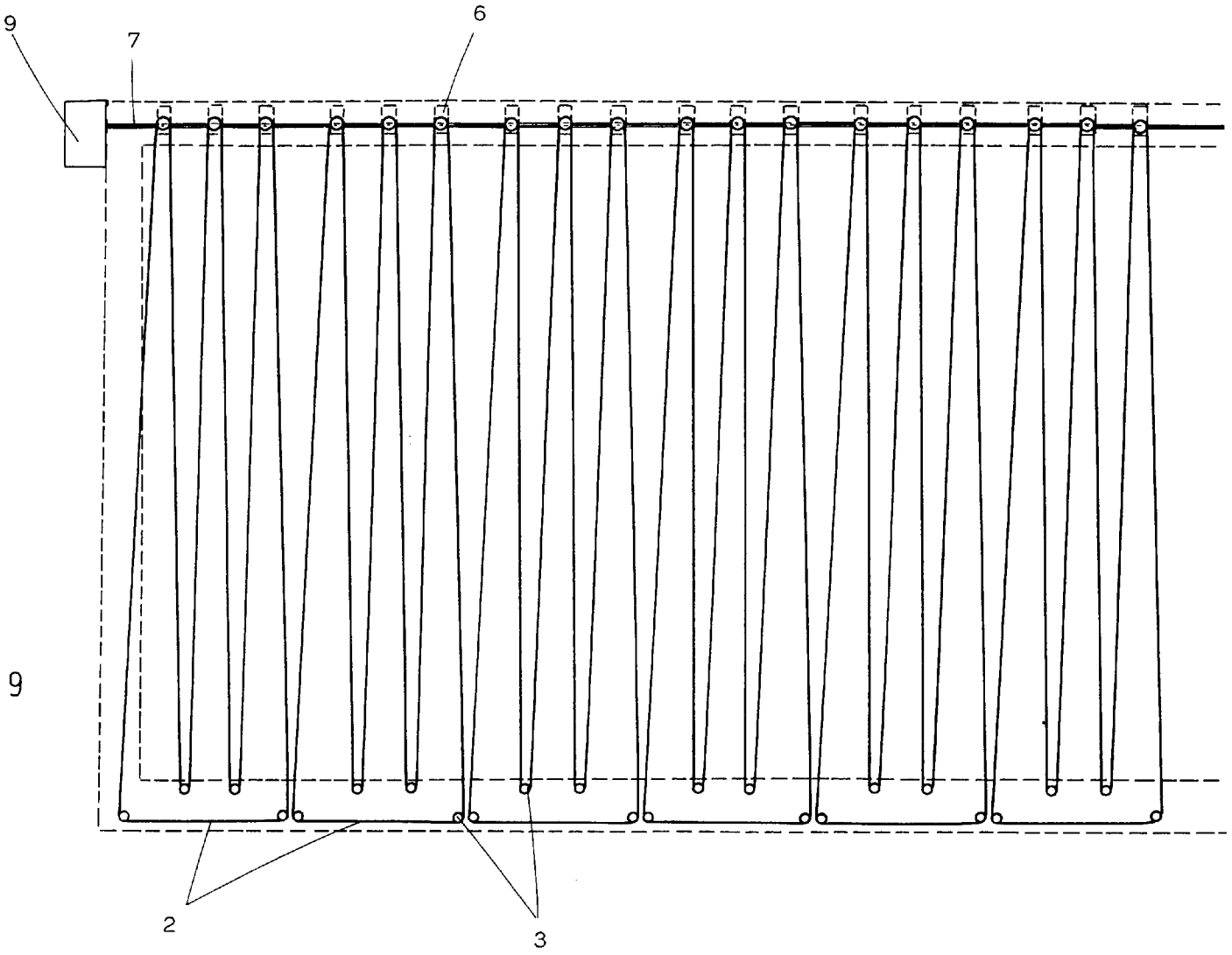
FIG. 9 is an upper view of a "W" shaped in display surface, which allows greater housing capacity for images.
Figure 16:
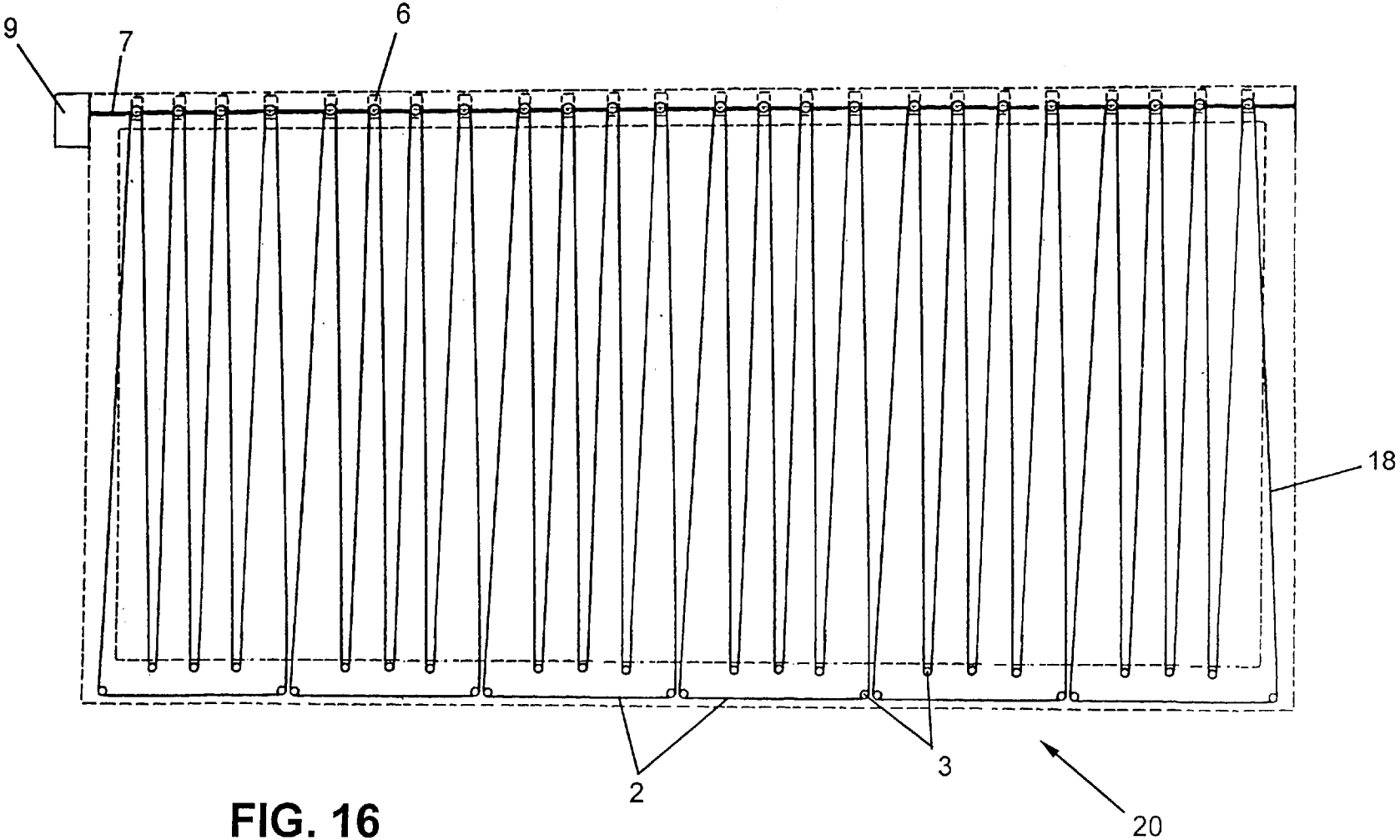
FIG. 16 is an upper view of an optical unit arranged in a WW shape.

From the above it is evident that if the system contains one hundred advertisement messages, each continuous web will contain one hundred optical lines, and if each optical line is ten centimeters wide, then the total length of each continuous web will be of ten meters, which will be located within the furniture in a "V" shaped arrangement as is appreciated in FIG. 7 or in a "W" shape as is appreciated in FIG. 9 or in a WW shaped as in FIG 16.

It is evident that given the features of the continuous web arrangement within the furniture containing the system of the present invention, it is possible to house a substantial enough amount of images or optical faces in a small size furniture. This further has the advantage that by the very arrangement of the continuous webs, the optical lines do not lose their shape, and the location thereof will always be flat and without wrinkles on its face.

Figure 12:
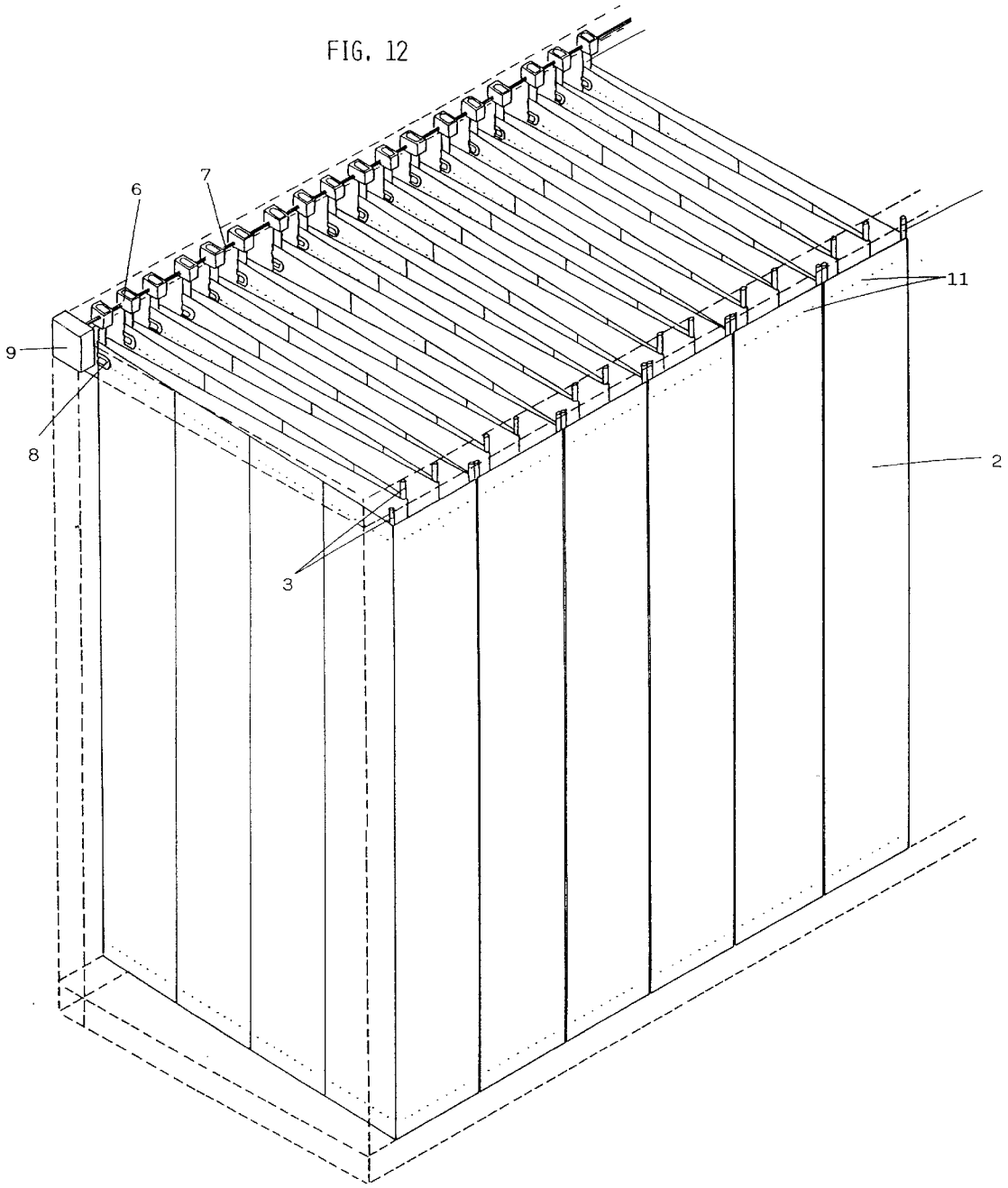
FIG. 12 is an upper perspective view of the "W" embodiment in FIG. 9.
Figure 13:
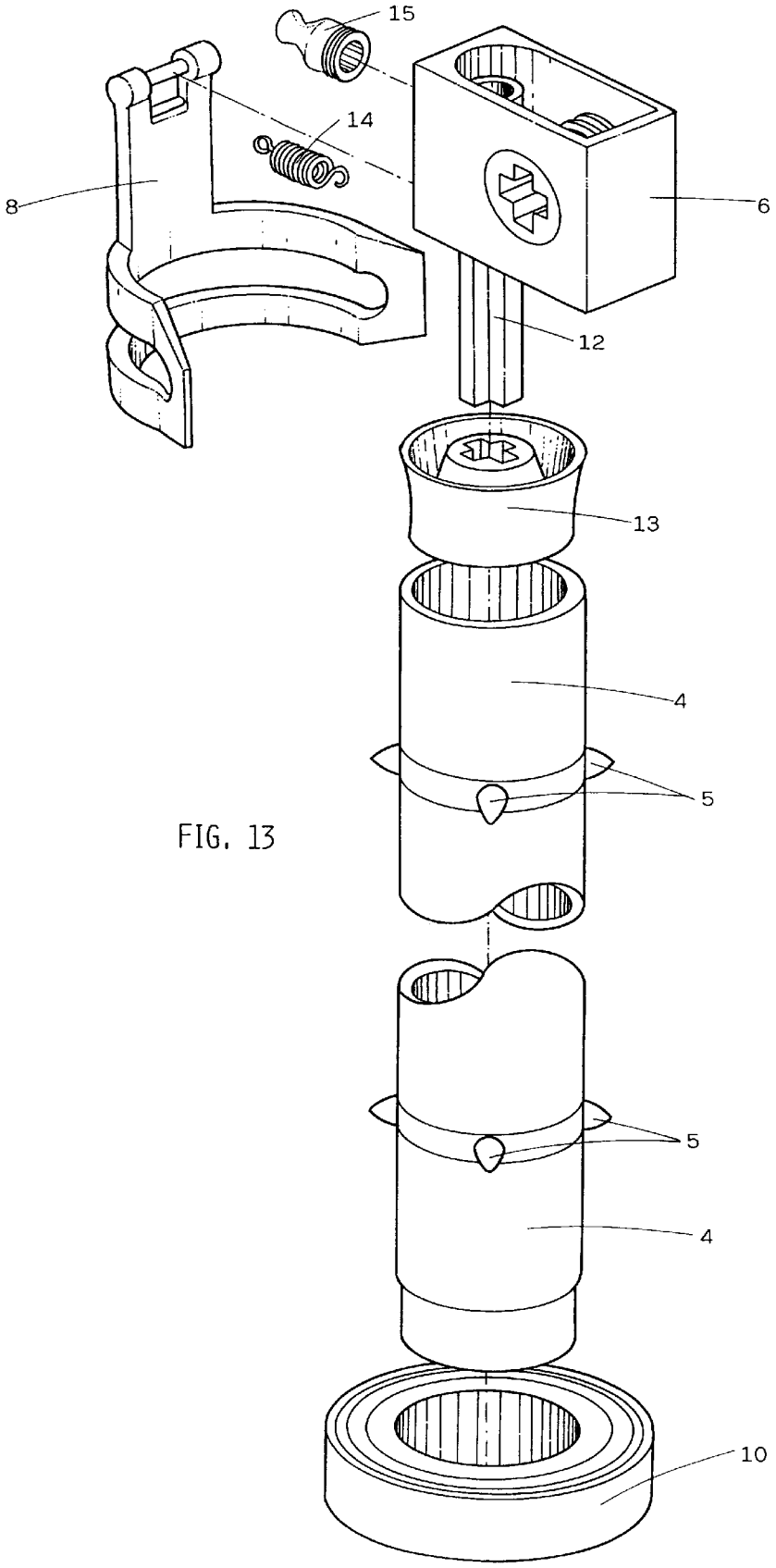
FIG. 13 is an exploded view of the lower roller with drag teeth in its upper and lower parts.
Figure 14:
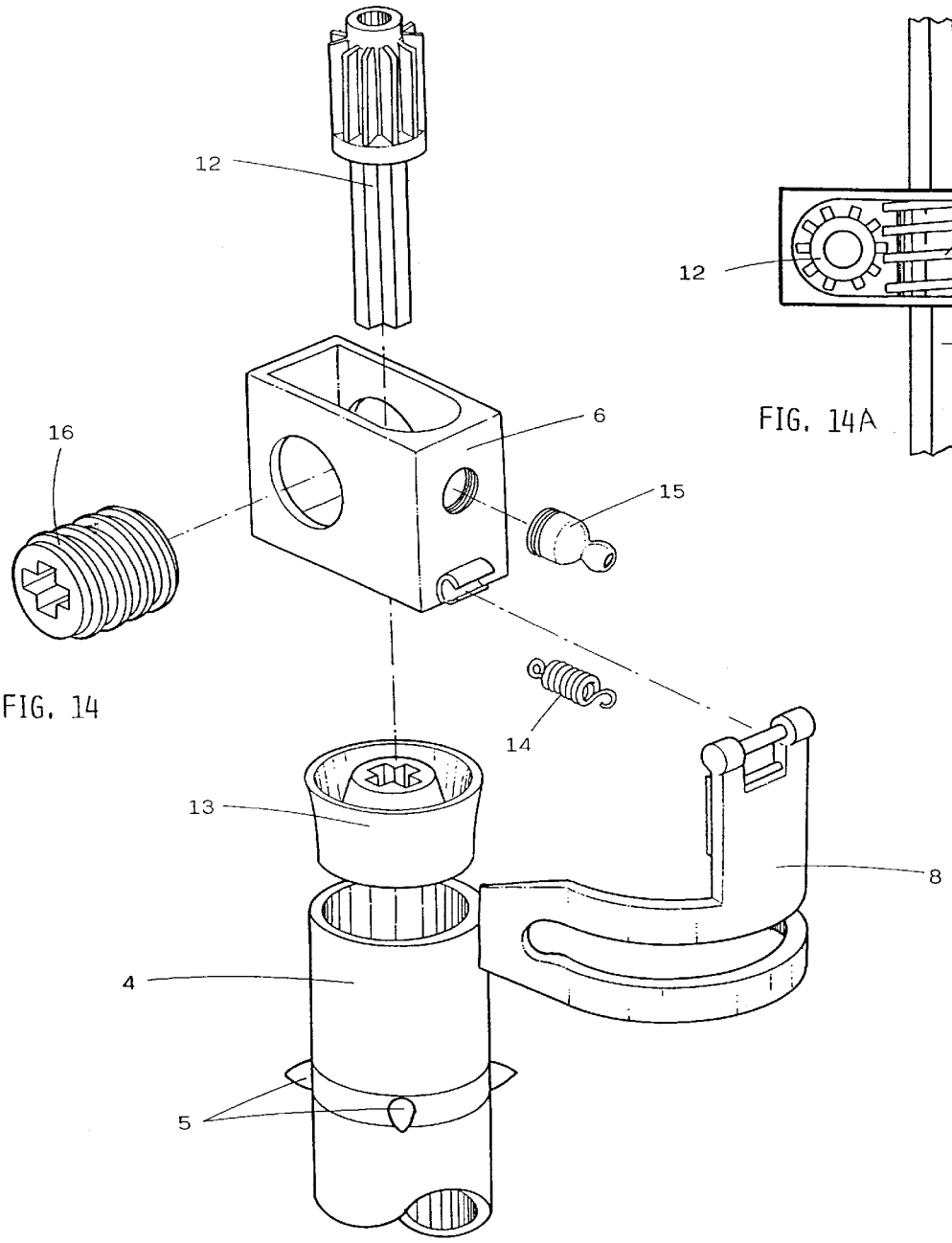
FIG. 14 is a break apart view of the synchronizer male gear.
Figure 14A:
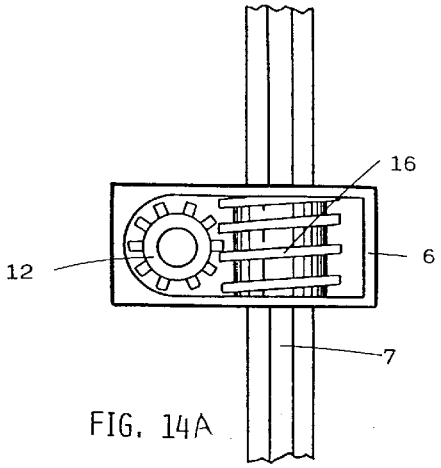
FIG. 14A is a plan view showing the engagement of the synchronizer male gear.
Figure 15:
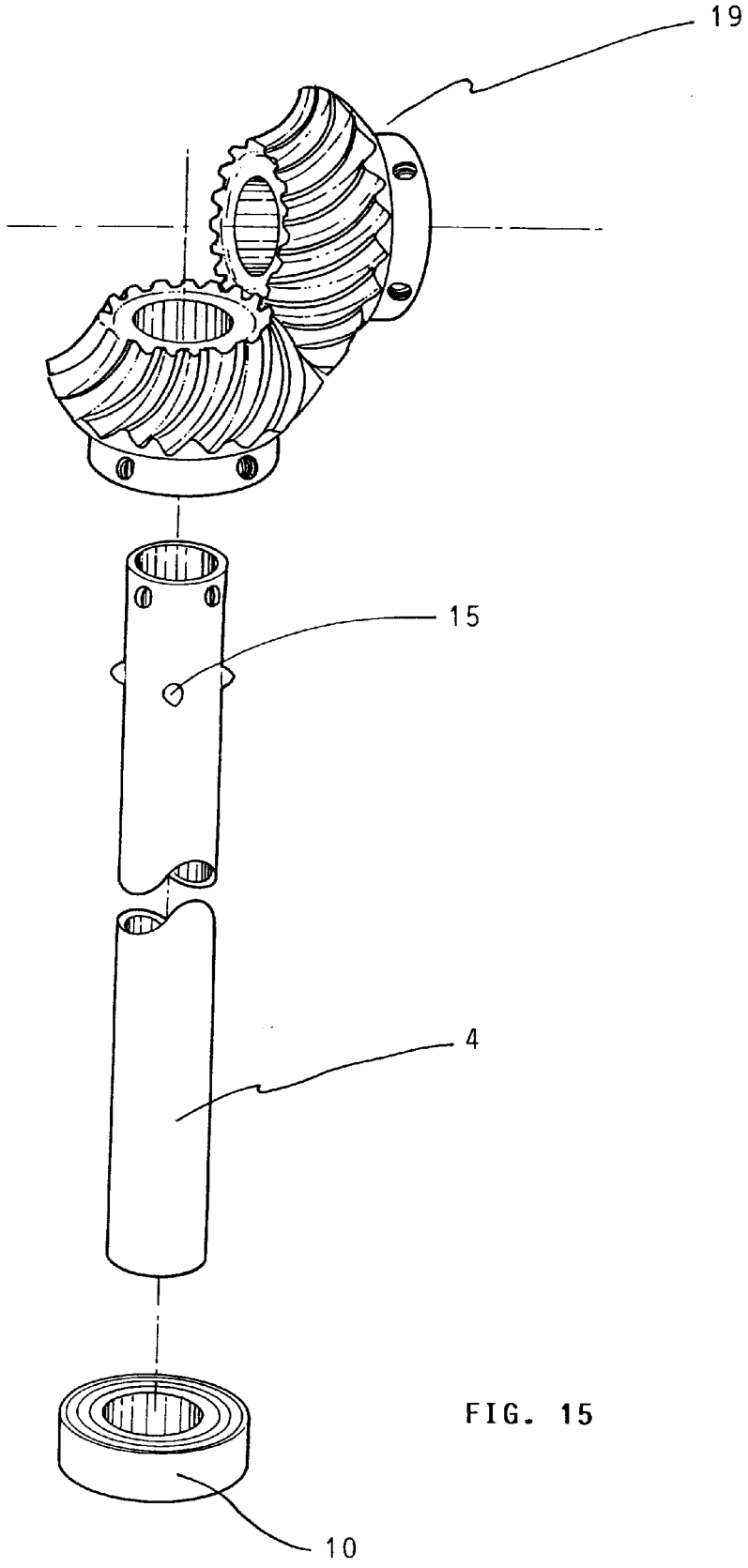
FIG. 15 is an exploded view of the synchronizer male gear in a crown and pinion embodiment.

In another embodiment of the invention as it is appreciated in FIGS. 9 and 12, each optical line unit (18) comprises a continuous web which is arranged in a "W" shape forming a path delimited by two frontal idle rollers (3) without drag teeth; another two auxiliary idle rollers (3) located further inside and further towards center than the frontal idle rollers (3) and three back rollers (4) with drag teeth, around which passes the endless web, providing a bigger housing capacity of optical line (2) per optical line unit (18) and a better inner distribution of the system within the furniture or structure.

The system of the present invention provides also the great possibility of creating animation, it is sufficient to program the timer of the motoreducer to carry out a rapid synchronical advancement. In this way, the simultaneous sequential appearing of the optical lines will create a movement effect of the images, similar to that obtained with a cinematographer movie projection. This is possible thanks to the fact that in the joints between optical lines the definition is not lost upon reading or in the image.

The versatility of the present invention is even more evident when foreseeing the housing of a determined amount of images in one face and another equal amount of images on the opposite face, with the condition that the width of the optical lines in the both faces is the same.

On the other side, without changing the original form of the structure, the optical lines are drawn in a horizontal, vertical, diagonal or perpendicular sense, moving the webs in one way or another.

Figure 8:
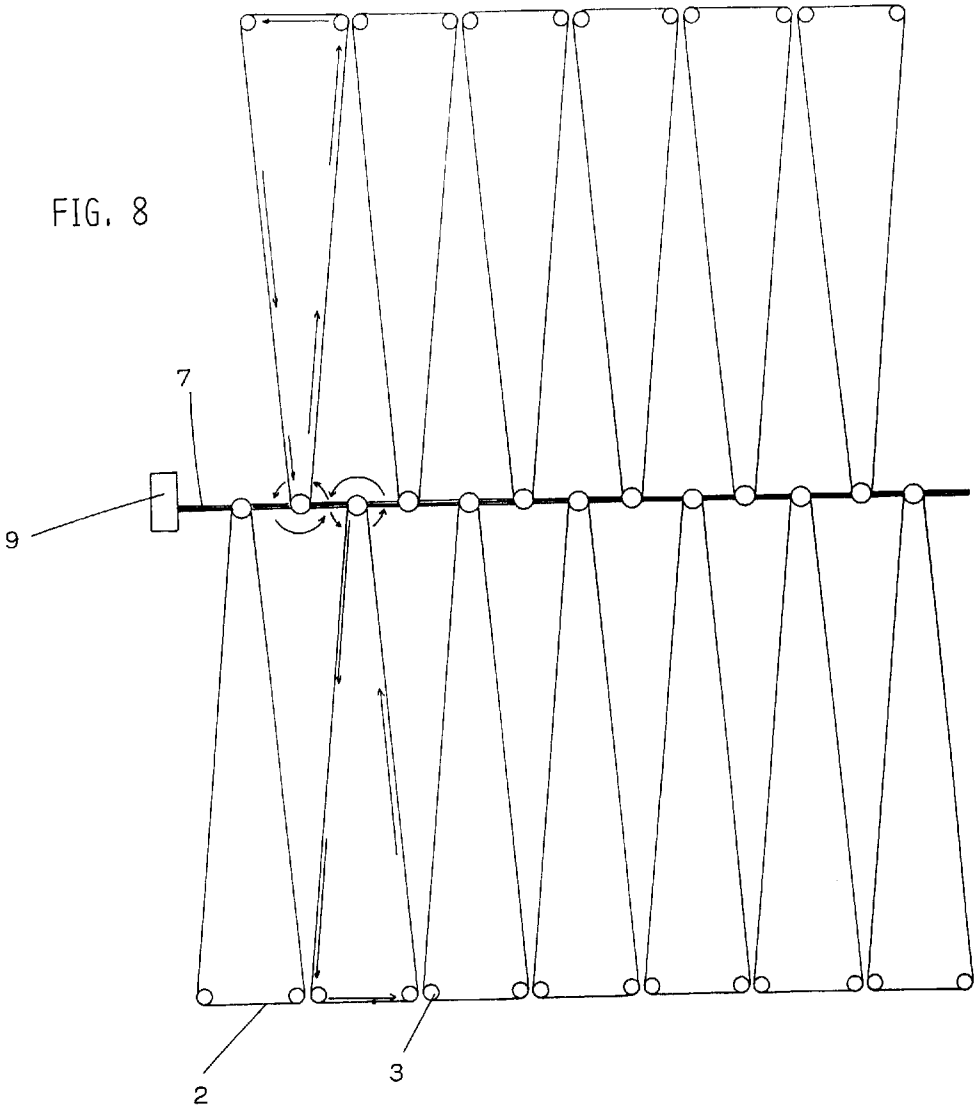
FIG. 8 is shown as an alternative embodiment of a double display face, in which webs are rotated by a central synchronizer axis, with synchrony in both faces.

The visual representation device of the present invention can be modified in a way that using the embodiment shown in FIG. 8 in which there is used a single central synchronizer axis (7) driving simultaneously two sets of endless webs (18) with optical lines units, it can display visual information simultaneously in two faces, both front as well as back, leaving useful thickness to both sides and upper part for fixed images.

The lighting for the displayed images, will be selected according to the materials used in the screens and can be internal or external.

Evidently, the visual representation system of the present invention can be sustained over a unipolar structure, or on square, cubic, embedded in walls, structures in locomotive, terrestrial, maritime, aerial vehicles, etc., located inside, outside and can be held hanging.

Additionally, the versatility of the system allows the increase in the number of rollers per optical line to achieve a larger housing in the endless web, such as for example in the "W" or "WW" arrangement.

The optical lines can be horizontal, vertical or diagonal, and the endless webs can spin either ways or facing each other. Additionally, the web has a transparent protection on its front face. The lighting of the system can be with internal or external lights. The surface can be flat or undulated and at different heights.

The optical line units, constituted by the endless webs can be printed, computer printed or prepared for immediate assembly, etc.

Having thus described invention as above, it is claimed as property that contained in the following:

I claim:

1. A system for applying continuous advertisements in a display device with continuous or sequential animation comprising the combination of a plurality of fractions of an image located in parallel adjacent relation to form the image, comprising a support structure presenting two opposite visual display surfaces formed by the combination of two sets of complementary optical lines contained in a plurality of optical line units, each one of which is formed by an endless web, having printed in its frontal surface a plurality of optical lines, the optical lines forming said fractions of images located one aside the other in a synchronized sequential manner which upon combining form the complete image of the visual display, the system acts through a forward movement action produced by an interval-timed motoreducer, which causes rotation of a central synchronizer about its axis, coupled to a synchronizer male gear located in each one of the optical line units; the synchronizer male gear upon being driven causes the rotation of a respective back roller having drag teeth in its upper and lower parts, providing simultaneous and synchronized movement of each endless web; each endless web, having perforations in its upper and lower parts, the perforations being engaged with the drag teeth of the back gear at the upper and lower parts, causing the endless web to travel in the front part of each optical line unit, two frontal idle rollers, without drag teeth being supported by front bearings being engaged with the web of each optical line unit to provide tension and uniform quadrature to the web, rotating continuously by the back roller in a way that the optical line units, collectively form the complete image at the front of the display device; the back rollers, are rotatably supported at their lower parts with back bearings and at their upper parts are held to a synchronizer male gear driving the central synchronizer which drives simultaneously the two sets of endless webs with optical line units for displaying information simultaneously in two opposite faces.

2. A system for applying continuous advertisements, according to claim 1, wherein the synchronized movement of the plurality of continuous webs provided by said interval-times motoreducer, which can be programmed in a way that the images remain stationary during a desired time; the motoreducer provides a rotation movement of the central synchronizer, which in turn is coupled by means of a geared system to the upper part of each one of the back rollers in a way that rotation movement of a rod that constitutes the horizontal, central, synchronizer, provides the simultaneous drive movement of all the back rollers in a perfectly synchronized manner.

3. A system for applying continuous advertisements, according to claim 1, wherein the back rollers are supported at their lower parts by the back bearings and the upper parts are driven by a synchronizer male gear that moves the central synchronizer.

4. A system for applying continuous advertisements, according to claim 1, wherein each of the back rollers is provided, in a place near each one of their two ends, with a plurality of small protrusions or drag teeth located in an equidistant peripheral manner which, couple with the corresponding perforations of the continuous web, in a way that when the back rollers rotate, the drag teeth are coupled to the corresponding perforations of the continuous web thus providing an advance movement while remaining coupled to the corresponding perforations of the continuous web.

5. A system for applying continuous advertisements, according to claim 1, wherein the optical lines are represented over the continuous web surface in a sequential manner, in a way that depending on the number of images or advertisement messages contained in the continuous web, each optical line will have its complementary lines located at a distance equivalent to the number of messages contained in the continuous web.

6. A system for applying continuous advertisements, according to claim 1, wherein each optical line unit is divided into a plurality of parallel optical lines, the continuous web constituting each optical line unit being made of several materials provided with information on its frontal surface.

7. A system for applying continuous advertisements according to claim 1, wherein the information is provided by means of endless webs made of plastic coated canvasses.

8. A system for applying continuous advertisements in a display device with continuous or sequential animation comprising the combination of a plurality of fractions of an image located in parallel, adjacent relation, including a support structure presenting a visual display surface formed by a combination of complementary optical lines contained in a plurality of optical line units, each optical line unit being formed by an endless web, having a frontal surface printed with a plurality of said optical lines; said optical lines forming fractions of images located one aside the other in a synchronized sequential manner which upon combining form a complete image of the visual display, the system being operated by a forward drive movement produced by an interval-timed motoreducer, which causes rotation of a central synchronizer about an axis thereof, said central synchronizer being coupled to a synchronizer male gear located in each one of the optical line units; the synchronizer male gear upon being driven producing rotation of a respective back roller having drag teeth in its upper and lower parts, to cause simultaneous and synchronized movement of each said endless web; each said endless web having perforations in its upper and lower parts; the perforations providing engagement with a respective said back roller to rotate the endless web; each optical line unit formed by its respective said endless web having a front part in which there are located two frontal idle rollers, without drag teeth, supported by front bearings, said idle rollers providing tension and uniform quadrature to the endless web, rotating continuously in the direction driven by the back roller such that said optical line units, will collectively advance in synchronized sequence and form a perfect image on its frontal face; the back rollers being rotatably supported in their lower parts by back bearings and in their upper parts being engaged with said synchronizer male gear and driven by said central synchronizer, wherein the web of each said optical unit is arranged in a "W" shape forming a path limited by two front idle rollers without drag teeth, another two auxiliary idle rollers located further inside and further to the center than the two front idle rollers and three back rollers with drag teeth disposed in such a manner that the endless web passes around the whole assembly of said rollers.

9. A system for applying continuous advertisements in a display device with continuous or sequential animation comprising the combination of a plurality of fractions of an image located in parallel, adjacent relation, including a support structure presenting a visual display surface formed by a combination of complementary optical lines contained in a plurality of optical line units, each optical line unit being formed by an endless web, having a frontal surface printed with a plurality of said optical lines; said optical lines forming fractions of images located one aside the other in a synchronized sequential manner which upon combining form a complete image of the visual display; the system being operated by a forward drive movement produced by an interval-timed motoreducer, which causes rotation of a central synchronizer about an axis thereof, said central synchronizer being coupled to a synchronizer male gear located in each one of the optical line units; the synchronizer male gear upon being driven producing rotation of a respective back roller having drag teeth in its upper and lower parts to cause simultaneous and synchronized movement of each said endless web; each said endless web having perforations in its upper and lower parts; the perforations providing engagement with a respective said back roller to rotate the endless web; each optical line unit formed by its respective said endless web having a front part in which there are located two frontal idle rollers, without drag teeth, supported by front bearings, said idle rollers providing tension and uniform quadrature to the endless web, rotating continuously in the direction driven by the back roller such that said optical line units, will collectively advance in synchronized sequence and form a perfect image on its frontal face; the back rollers being rotatably supported in their lower parts by back bearings and in their upper parts being engaged with said synchronizer male gear and driven by; said central synchronizer wherein the web of each said optical line unit is arranged in the shape of "WW" forming a path limited by two frontal idle rollers without drag teeth, and another three auxiliary idle rollers located further inside and further to the center than the two frontal idle rollers and four back rollers with drag teeth, disposed in such a manner that the endless web passes around the whole assembly of rollers.

10. A system for applying continuous advertisements according to claim 9, wherein the synchronized movement of the plurality of continuous webs provided by said interval-timed motoreducer, which can be programmed in a way that the images remain stationary during a desired time; the motoreducer provides a rotation movement of the central synchronizer, which in turn is coupled by means of a geared system to the upper part of each one of the back rollers in a way that rotation movement of a rod that constitutes the horizontal, central, synchronizer, provides the simultaneous drive movement of all the back rollers in a perfectly synchronized manner.

11. A system for applying continuous advertisements according to claim 9, wherein each of the back rollers is provided, in a place near each one of their two ends, with a plurality of small protrusions or drag teeth located in an equidistant peripheral manner which, coupled with the corresponding perforations of the continuous web, in a way that when the back rollers rotate, the drag teeth are coupled to the corresponding perforations of the continuous web thus providing an advance movement while remaining coupled to the corresponding perforations of the continuous web.

12. A system for applying continuous advertisements according to claim 9, wherein the optical lines are represented over the continuous web surface in a sequential manner, in a way that depending on the number of images or advertisement messages contained in the continuous web, each optical line will have its complementary lines located at a distance equivalent to the number of messages contained in the continuous web.

13. A system for applying continuous advertisements, according to claim 9, wherein each optical line unit is divided into a plurality of parallel optical lines, the continuous web constituting each optical line unit being made of several materials provided with information on its frontal surface.

14. A system for applying continuous advertisements according to claim 13, wherein the information is provided by means of plastic coated canvasses.

* * * * *